US007008197B2

(12) United States Patent
Ford

(10) Patent No.: US 7,008,197 B2
(45) Date of Patent: Mar. 7, 2006

(54) DEBRIS EVACUATION APPARATUS AND METHOD FOR AN OIL PUMP

(76) Inventor: Michael Brent Ford, 2716 Rio Vista, St. George, UT (US) 84790

( * ) Notice: Subject to any disclaimer, the term of this patent is extended or adjusted under 35 U.S.C. 154(b) by 290 days.

(21) Appl. No.: 10/632,201

(22) Filed: Jul. 30, 2003

(65) Prior Publication Data

US 2005/0025644 A1 Feb. 3, 2005

(51) Int. Cl.
*F04B 39/00* (2006.01)
*F04B 53/00* (2006.01)

(52) U.S. Cl. ..... 417/430; 417/555.2; 417/53; 166/105.1

(58) Field of Classification Search ..... 417/430, 417/53, 555.2; 166/105.1, 105.2, 105.3, 166/105.4, 110
See application file for complete search history.

(56) References Cited

U.S. PATENT DOCUMENTS 2,231,861 A * 2/1941 Adams ..... 417/459
4,148,735 A * 4/1979 Laval, Jr. ..... 210/512.1
4,421,182 A * 12/1983 Moody et al. ..... 175/65
4,662,831 A * 5/1987 Bennett ..... 417/430
5,314,018 A * 5/1994 Cobb ..... 166/265
5,474,601 A * 12/1995 Choi ..... 96/182
6,135,203 A * 10/2000 McAnally ..... 166/105.2
6,145,590 A * 11/2000 Havard ..... 166/105.2
6,148,923 A * 11/2000 Casey ..... 166/372
6,290,475 B1 * 9/2001 Snow ..... 417/430

* cited by examiner

*Primary Examiner*—William H. Rodriguez
(74) *Attorney, Agent, or Firm*—Jeffrey Weiss; Harry M. Weiss; Weiss, Moy & Harris, P.C.

(57) ABSTRACT

A debris evacuation apparatus and method evacuates debris in a pumping system that forms between the plunger exterior and barrel interior. The apparatus has at least one seal and one groove located south of the seal, with the seal blocking northward travel of debris and directing it to the groove. Ports within the groove permit debris to enter the debris evacuation apparatus. Interior to the debris evacuation apparatus, the entering debris will become mixed with pumped fluid, and will be drawn out of the pumping system with the pumped fluid. The pumped fluid passing through the debris evacuation apparatus will be caused to rotate by a screw-in insert located at a south portion of the debris evacuation apparatus, utilizing a plurality of angled veins surrounding a closed center section located at a north end of the screw-in insert.

20 Claims, 1 Drawing Sheet

DEBRIS EVACUATION APPARATUS AND METHOD FOR AN OIL PUMP

BACKGROUND OF THE INVENTION

1. Field of Invention

This invention relates generally to oil pumps and, more specifically, to a debris evacuation apparatus and method that is intended to extend plunger and barrel life.

2. Background of the Invention

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft is lined with piping known as "tubing." Into the tubing is inserted a sucker rod, which is ultimately, indirectly, coupled at its north end to the pumping unit. Below the sucker rod are located a number of pumping system components, including the cage and, below the cage, the plunger. The plunger operates within a barrel, which barrel is positioned within the tubing.

The amount of space between the exterior surface of the plunger and the interior surface of the barrel can be as great as 0.01". This space allows a constant passage of fluid, including debris, between the plunger exterior and the barrel interior. The debris that is contained within the fluid and that passes through the space between plunger and barrel scores the plunger and the barrel, reducing the operating life of both.

A need therefore existed for an apparatus and method that will evacuate debris from the space that is between the plunger and the barrel, so as to extend the operating life of each of these two pumping system components. The present invention addresses this need and provides other, related, advantages.

SUMMARY OF THE INVENTION

It is an object of the present invention to provide an apparatus and method that will evacuate debris from the space that is between the plunger and the barrel, so as to extend the operating life of each of these two pumping system components.

DETAILED DESCRIPTION OF THE PREFERRED EMBODIMENTS

Figure 1:
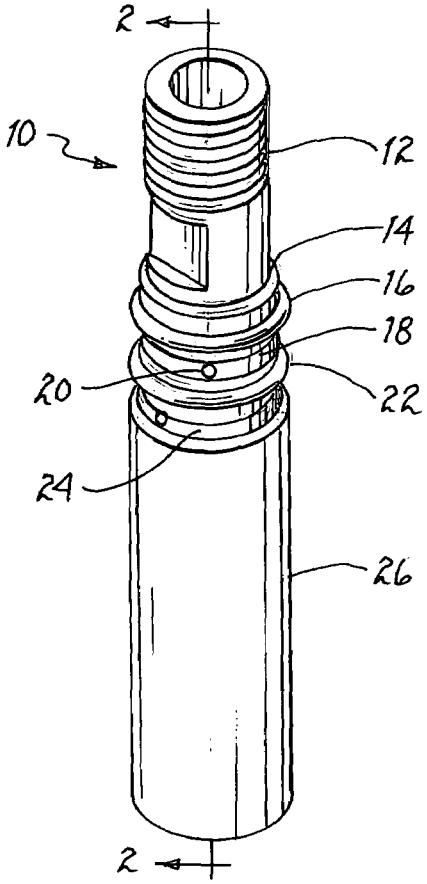
FIG. 1 is a perspective of a debris evacuation apparatus consistent with an embodiment of the present invention.
Figure 2:
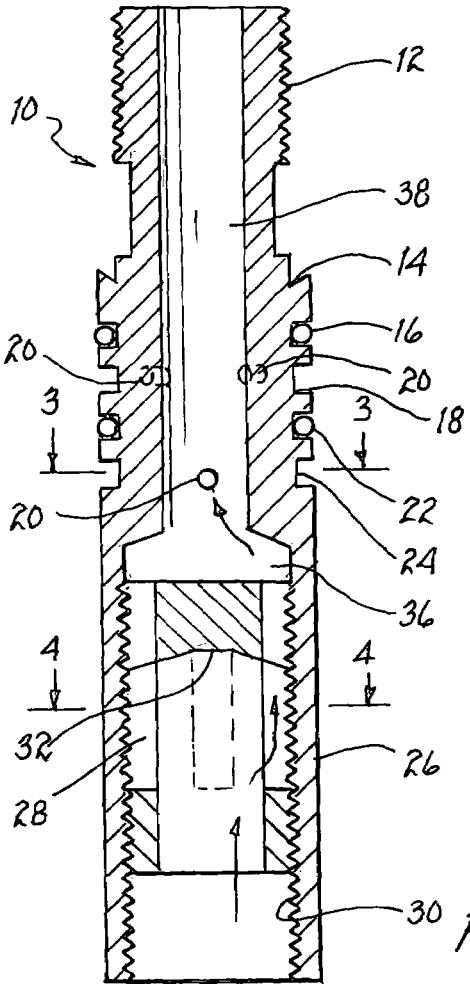
FIG. 2 is a side, cross-sectional view of the apparatus of FIG. 1, taken along line 2—2.

Referring first to FIGS. 1–2, an embodiment of the debris evacuation apparatus 10 of the present invention is shown. In describing the structure of the apparatus 10 and its operation, the terms "north" and "south" are utilized. The term "north" is intended to refer to that end of the pumping system that is more proximate the pumping unit, while the term "south" refers to that end of the system that is more distal the pumping unit, or "downhole."

Beginning from the north end (the top in the drawing figures), the main exterior topography of this embodiment of the apparatus 10, which has a substantially cylindrical external configuration, includes the following: (a) an external threaded section 12; (b) a collar area 14; (c) an upper seal 16; (d) an upper groove 18; (e) ports 20; (f) a lower seal 22; (g) a lower groove 24; and (h) a main shaft 26.

Figure 3:
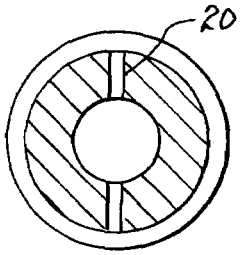
FIG. 3 is a top view of the apparatus of FIG. 1.
Figure 4:
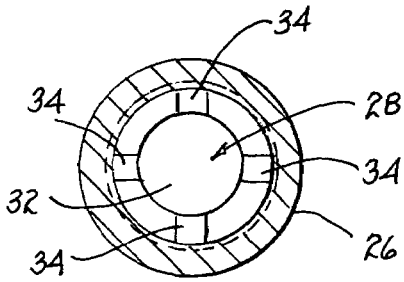
FIG. 4 is a bottom view of the apparatus of FIG. 4.

Referring to FIGS. 2–4, looking now interiorly, it can be seen that there is a screw-insert 28 located within the main shaft 26. The screw-insert 28 is threadably engaged by internal threaded section 30. The screw-in insert 28 preferably is closed about an upper, center section 32, which section 32 is surrounded by four directional veins 34 (see FIG. 4). The veins 34 are angled, so as to impart rotation to fluid passing therethrough, as discussed below. The screw-in insert 28 is positioned below an expansion chamber 36, which is an area of increased diameter within the main shaft 26. Above the expansion chamber 36 is a passage 38, having a diameter that is less than that of the expansion chamber 36. It can be seen that the ports 20 extend through to the passage 38.

The seals 16 and 22 are preferably formed of a urethane type of material, although other suitable sealing materials could be utilized. The seals 16 and 22 should be positioned, and dimensioned, so as to contact the interior of the barrel, forming a seal. (It should be noted that it would be possible to entirely eliminate seals 16 and 22, while still preserving much of the functionality of the apparatus 10 as described herein.)

The tolerance between the exterior of the main shaft 26 and the interior of the barrel should be approximately 0.002"—i.e., substantially less than the approximately 0.01" tolerance commonly seen between the plunger and barrel. This configuration permits the main shaft 26 to act as a guide for the seals 16 and 22, thus taking from the seals 16 and 22 some of the side load.

The preferred placement of the apparatus 10 within a pumping system will now be described. It is preferred to couple the north end of the apparatus 10 to the south end of the open cage, by inserting external threaded section 12 into a mating threaded region within the south end of the open cage. It is preferred to couple the south end of the apparatus 10 to the north end of the plunger, by inserting the threaded north end of the plunger into the internal threaded section 30. As can be seen in FIG. 2, sufficient space should be provided below the screw-in insert 28 to permit insertion of the north end of the plunger. (It should be noted that it would be possible to provide the apparatus 10 as an integral portion of one-piece assembly that includes both the apparatus 10 and the plunger, as opposed to making the two components detachable one from the other.)

It should be noted that, instead of positioning the screw-insert 28 interior to the main shaft 26, it would be possible to position it below the main shaft 26. In such a configuration, it would be desirable to provide a threaded exterior space at the north end of the screw-insert 28, to be inserted into the south end of the apparatus 10, and a threaded interior space at the south end of the screw-insert 28 of sufficient dimension to receive the north end of the plunger.

Further description and explanation of the features of the apparatus 10 and its use will be provided in connection with a description of the operation of the apparatus 10 during a typical pumping operation.

First, it should be noted that upward movement of the pumped fluid occurs during the downstroke. Referring now to FIG. 2, during the downstroke, fluid will enter through the south end of the apparatus 10. The fluid will enter the interior of the screw-in insert 28. It will continue northward, until contacting the center section 32. The upward movement of the fluid will be blocked by the center section 32, causing it to change direction and to enter the veins 34 so as to be able to continue the upward travel.

The angling of the veins 34 imparts rotational movement to the fluid as it passes therethrough. The fluid, which is now in rotation, enters the expansion chamber 36. The increase in diameter causes an increase in the velocity of the rotating fluid. The fluid continues to rotate as it travels upward, through the passage 38. The rotation of the fluid creates a vortex, with an area of lower pressure in the interior of the vortex.

Northward travel of debris located exterior to the apparatus 10 and below seal 22 will be blocked by seal 22. The debris will enter the lower groove 24 and will be drawn through the port 20. The drawn-in debris then joins the fluid travelling upward through the apparatus 10, and is pumped out. In the event that seal 22 becomes worn or otherwise in the event that debris enters the area above seal 22, debris will be blocked by seal 16 and enter upper groove 18, and be drawn in through ports 20 therein, as herein-described.

It can be seen that it would be possible to eliminate the upper groove 28 and seal 16 (including the ports 20 associated with the upper groove 28), while still providing a substantial improvement in debris removal.

Attention is now directed to collar area 14. The purpose of the inwardly angled collar area 14 is to trap debris located north of the apparatus 10. On the upstroke, such debris will become trapped within the collar area 14. On the downstroke, the debris will mix with pumped fluid coming out of the cage, and will be drawn up the barrel. While it is preferred to have a collar area 14 to further optimize debris removal, it would be possible to provide substantial improvement in debris removal without providing the collar area 14.

While the invention has been particularly shown and described with reference to preferred embodiments thereof, it will be understood by those skilled in the art that the foregoing and other changes in form and details may be made therein without departing from the spirit and scope of the invention.

I claim:

1. A debris evacuation apparatus for use in a pumping apparatus comprising, in combination:

a first seal positioned circumferentially about said debris evacuation apparatus;

a first groove located south of said first seal;

at least one port extending through said first groove to a passage within an interior of said debris evacuation apparatus;

a main shaft located south of said first groove; and a screw-in insert located south of said first groove;

wherein said screw-in insert is open at a south end thereof to receive a flow of fluid, and wherein at a north end of said screw-in insert there is located a closed center section surrounded by a plurality of angled veins, so that fluid travelling north within said screw-in insert will be blocked by said center section and forced through said angled veins, with said angled veins imparting rotation to said fluid as it travels northward.

2. The debris evacuation apparatus of claim 1 further comprising an external threaded section at a north end thereof, north of said first seal.

3. The debris evacuation apparatus of claim 2 wherein said external threaded section is adapted to be received within a mating section proximate a south end of an open cage.

4. The debris evacuation apparatus of claim 1, further comprising an inwardly inclined collar area located north of said first seal.

5. The debris evacuation apparatus of claim 1, wherein said first seal is comprised of urethane.

6. The debris evacuation apparatus of claim 1, further comprising a second seal positioned circumferentially about said debris evacuation apparatus south of said first groove.

7. The debris evacuation apparatus of claim 6, wherein said second seal is comprised of urethane.

8. The debris evacuation apparatus of claim 6, further comprising a second groove located south of said second seal.

9. The debris evacuation apparatus of claim 8, further comprising at least one port extending through said second groove to said passage.

10. The debris evacuation apparatus of claim 1, further comprising an expansion chamber located north of said screw-in insert and south of said passage, and wherein said expansion chamber has a diameter that is greater than that within said screw-in insert and greater than that within said passage.

11. The debris evacuation apparatus of claim 1, wherein said screw-in insert is located within an interior portion of said main shaft.

12. A method for evacuating debris from a pumping apparatus comprising the steps of:

providing a debris evacuation apparatus comprising, in combination:

a first seal positioned circumferentially about said debris evacuation apparatus;

a first groove located south of said first seal;

at least one port extending through said first groove to a passage within an interior of said debris evacuation apparatus;

a main shaft located south of said first groove;

a screw-in insert located south of said first groove;

wherein said screw-in insert is open at a south end thereof to receive a flow of fluid, and wherein at a north end of said screw-in insert there is located a closed center section surrounded by a plurality of angled veins, so that fluid travelling north within said screw-in insert will be blocked by said center section and forced through said angled veins, with said angled veins imparting rotation to said fluid as it travels northward;

pumping fluid through said debris evacuation apparatus;

said fluid travelling northward through said screw-in insert and said passage;

drawing debris in through said ports in said first groove;

said fluid and said debris exiting a north end of said debris evacuation apparatus.

13. The method of claim 12 wherein said debris evacuation apparatus further comprises an external threaded section at a north end thereof, north of said first seal.

14. The method of claim 13 further comprising the step of coupling said external threaded section to a mating section proximate a south end of an open cage.

15. The method of claim 12, wherein said debris evacuation apparatus further comprises an inwardly inclined collar area located north of said first seal, and further comprising the step of capturing debris in said inwardly inclined collar area.

16. The method of claim 12, wherein said debris evacuation apparatus further comprises a second seal positioned circumferentially about said method south of said first groove.

17. The method of claim 16, wherein said debris evacuation apparatus further comprises a second groove located south of said second seal, having at least one port extending therethrough, and further comprising the step of drawing debris in through said ports in said second groove.

18. The method of claim 12, wherein said debris evacuation apparatus further comprises an expansion chamber located north of said screw-in insert and south of said passage, and wherein said expansion chamber has a diameter that is greater than that within said screw-in insert and greater than that within said passage.

19. The method of claim 12, wherein said screw-in insert is located within an interior portion of said main shaft.

20. The method of claim 12, wherein said screw-in insert is located south of said main shaft.

* * * * *